US005419094A

United States Patent [19]

Vander Bush, Jr. et al.

[11] Patent Number: 5,419,094

[45] Date of Patent: May 30, 1995

[54] CONSTANT SPEED SPINDLES FOR ROTARY CAPPING MACHINE

[75] Inventors: Edward F. Vander Bush, Jr., Downingtown, Pa.; John M. Mathy, Jr., Belcamp, Md.; Lehew W. Miller, Jr., Richmond; James L. Anderson, Chesterfield, both of Va.

[73] Assignee: Crown Cork & Seal Company, Inc., Philadelphia, Pa.

[21] Appl. No.: 204,543

[22] Filed: Mar. 2, 1994

[51] Int. Cl.[6] ..... B65B 7/28; B65B 57/00; B67B 3/20

[52] U.S. Cl. ..... 53/75; 53/317; 53/331.5

[58] Field of Search ..... 53/75, 317, 331.5, 76, 53/272, 276, 277, 278, 279, 280

[56] References Cited

U.S. PATENT DOCUMENTS

| | | | |
|---|---|---|---|
| 3,031,822 | 5/1962 | Dimond | 53/317 |
| 4,535,583 | 8/1985 | Tanaka et al. | 53/75 |
| 4,608,805 | 9/1986 | Kelly | 53/308 |
| 4,616,466 | 10/1986 | Tanaka et al. | 53/75 |
| 4,696,144 | 9/1987 | Bankaty et al. | 53/317 |
| 5,301,488 | 4/1994 | Ruhl et al. | 53/75 |
| 5,321,935 | 6/1994 | Spatz et al. | 53/75 |

*Primary Examiner*—James F. Coan
*Assistant Examiner*—Gene Kim
*Attorney, Agent, or Firm*—Reising, Ethington, Barnard, Perry & Milton

[57] ABSTRACT

A rotary capping machine (10) includes a nonrotating center shaft (26) about which a turret (28) is rotatably mounted. The turret (28) is rotated by a motor (30) whose speed can be adjusted to alter the bottle through put rate of the capping machine (10). A plurality of spindle shafts (44) are supported on the turret (28) in a circle about the center shaft (26). A rotary capping head (48) is positioned on the end of each spindle shaft (44) and includes a clutch mechanism. A drive motor (68) supported on the center shaft (26) rotates each of the spindle shafts (44) in unison through a compound and planetary gear train. As the spindle shafts (44) revolve about the center shaft (26), they are linearly reciprocated by a barrel cam (50) arrangement. A rotary encoder (78) senses the instantaneous rotational speed of the turret (28) and sends feed back signals to a CPU to control the drive motor (68) so the spindle shafts (44) always rotate at a field determined constant speed regardless of the turret speed. The speed may be adjusted up and down.

18 Claims, 5 Drawing Sheets

CONSTANT SPEED SPINDLES FOR ROTARY CAPPING MACHINE

TECHNICAL FIELD

The subject invention relates to a rotary bottle capping machine for threading caps onto bottles.

BACKGROUND ART

According to well established prior art design, rotary capping machines typically utilize a revolving turret with multiple spinning spindles arranged around the circumference of the turret. Each spindle carries an adjustable, magnetic capping head at its lower end and is rotationally driven by the rotation of the turret or an independent electric motor through a gear train so that all spindles turn at the same speed. Frequently, planetary gear trains are used in such arrangements where the rotational speed of the spindles varies proportionally with changes in the rotational speed of the turret.

During high volume production of bottles having screw cap closures, it is frequently necessary to alter the through put rate of the bottles, i.e., the number of threaded caps applied to the bottles over a given period of time, to account for changes or disturbances in the manufacturing and handling processes either up line or down line of the rotary capping machine.

As the capping machine applies threaded caps onto the necks of bottles, the final tightness of the caps is a product of two components. One component is contributed by the static torque setting of the clutch in the capping head, whereas the other component comprises the rotational interia of the components of the capping head that are in contact with the cap being applied. The former component is fixed with any one torque setting of the clutch, but the latter varies with the rotational velocity of the spindle. The torque applied by this arrangement to the caps is therefore the sum of the two components and is variable with the speed of the capping machine. Thus, while the static torque setting of the clutch and the capping head will remain constant for any speed of the spindles, the rotational interia (commonly referred to "dynamic torque") will increase with an increase in the rotating speed of the spindles, and conversely will decrease with a decrease in the rotating speed of the spindles. Hence, when the turret speed is increased to yield a higher through put of bottles, this dynamic torque factor will likely overtighten the bottle caps, possibly causing an improper seal or breakage. Conversely, when the turret drive motor is slowed considerably below normal values, the dynamic torque factor will contribute very little to final cap tightness and as a result may not properly seat the caps onto their bottles.

U.S. Pat. No. 4,608,805 to Kelley, issued Sep. 2, 1986, discloses a rotary capping machine having a rotating turret and a plurality of spindles. A first variable speed motor drives rotation of the turret, whereas a second variable speed motor drives rotation of the spindles independent of the turret speed. Such independent control of the spindle speed must be controlled on an ongoing basis by an operator as there is no communication between the first and second variable speed motors.

Various other configurations have been proposed for controlling the final torque tightness of threaded caps, such as shown in U.S. Pat. No. 4,616,466, issued Oct. 14, 1986, and U.S. Pat. No. 4,535,583, issued Aug. 20, 1985, both assigned to the Shibuya Kogyo Company. However, these as well as various other such control mechanisms have proved inadequate to maintain cap tightness at high speed, i.e., high through put, operation and on a consistently reliable basis.

SUMMARY OF THE INVENTION AND ADVANTAGES

The subject invention contemplates a capping apparatus for threading caps onto bottles at a constant threading speed independent of bottle through put rate. The apparatus comprises a center shaft having a vertical central axis. The turret is rotatably carried about the center shaft. A turret drive means rotates the turret about the central axis at variable turret speeds to alter the bottle through but rate. A plurality of spindle shafts are spaced circumferentially about the central axis and are each rotatably supported on the turret. A capping head is disposed on each of the spindle shafts. A rotation means is provided for forcibly rotating each of the spindle shafts in unison about respective axes parallel to the central axis. The improvement of the invention comprises a control means for directly sensing the instantaneous turret speed and reactively controlling the rotation means to rotate the spindle shafts at a constant rotational speed to thread caps onto the bottles with a constant final torque tightness independent of the turret speed and the bottle through put rate.

The control means of the subject invention distinguishes it from the prior art capping apparatus by directly sensing the rotational speed of the turret at any given moment and sending feedback signals which cause the rotation means to maintain constant the spindle speed rotation. This, in effect, maintains the dynamic torque component of the cap tightness constant throughout any variations in the bottle through put rate. The control means may also be manually adjusted both to raise and lower the constant spindle speed. As spindle speed correlates to dynamic torque, the dynamic torque is then adjustable for any run condition.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
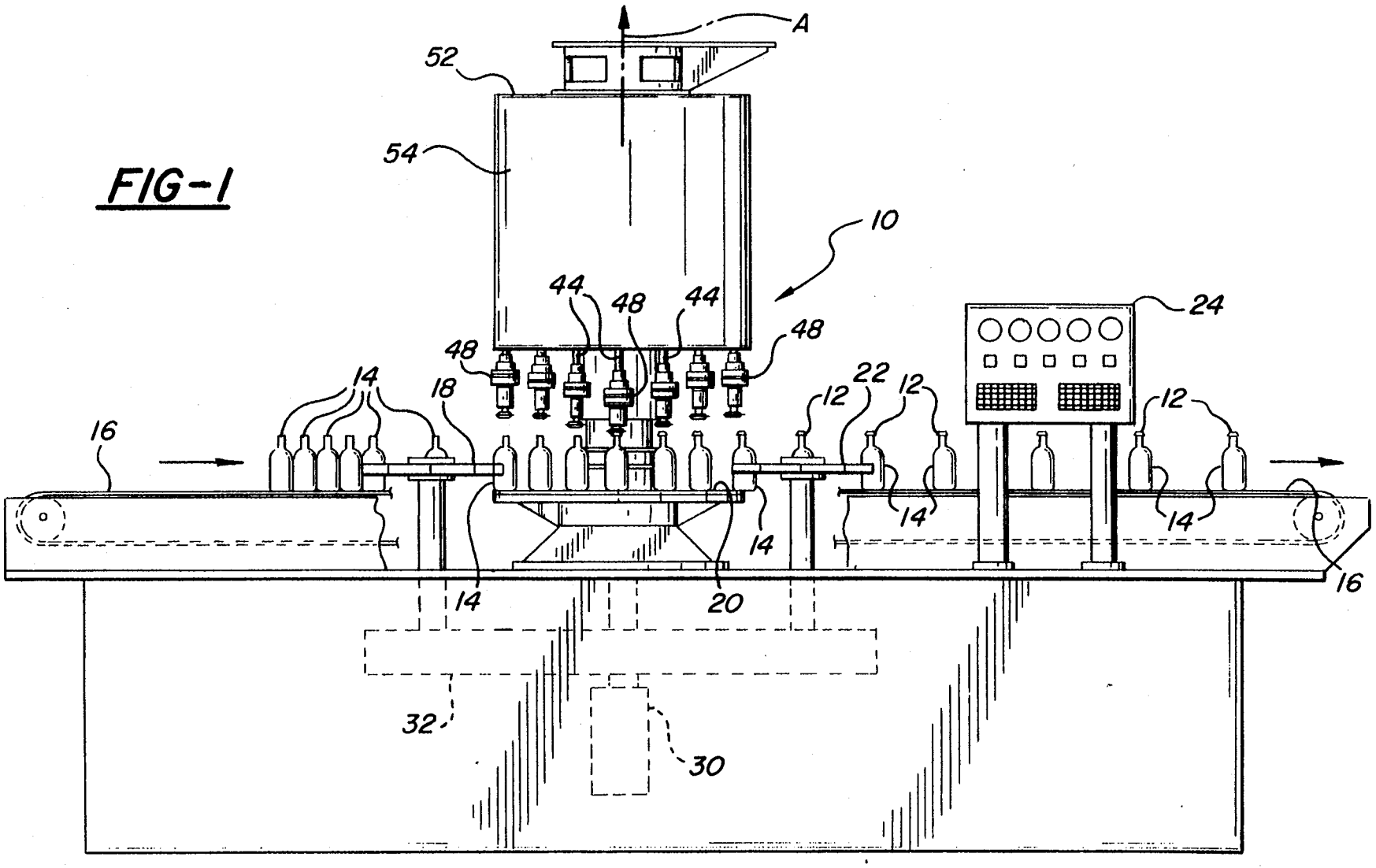
FIG. 1 is a simplified view of the capping apparatus according to the subject invention disposed for operation in an assembly line process.

Referring to the Figures, wherein like numerals indicate like or corresponding parts throughout the several views, a capping apparatus according to the subject invention is generally shown at 10. The capping apparatus 10 is of the type for threading caps 12 onto bottles 14 at a constant threading speed independent of the bottle 14 through put rate. In FIG. 1, the capping apparatus 10 is shown as part of an assembly line for filled bottles 14 received on an infeed side of a conveyor 16, and indexed by way of an infeed star wheel 18 onto a rotating table 20. While on the table 20, the bottles 14 are capped and then returned to an outfeed side of the conveyor 16 by way of an outfeed star wheel 22. A control panel 24 is provided for setting the through put rate of the capping apparatus 10, as well as signaling fault conditions, monitoring operation, etc. It will be readily appreciated by those skilled in the art that the capping operation illustrated in FIG. 1 is but a segment of an overall manufacturing, filling, labeling, handling and distribution process.

Figure 2:
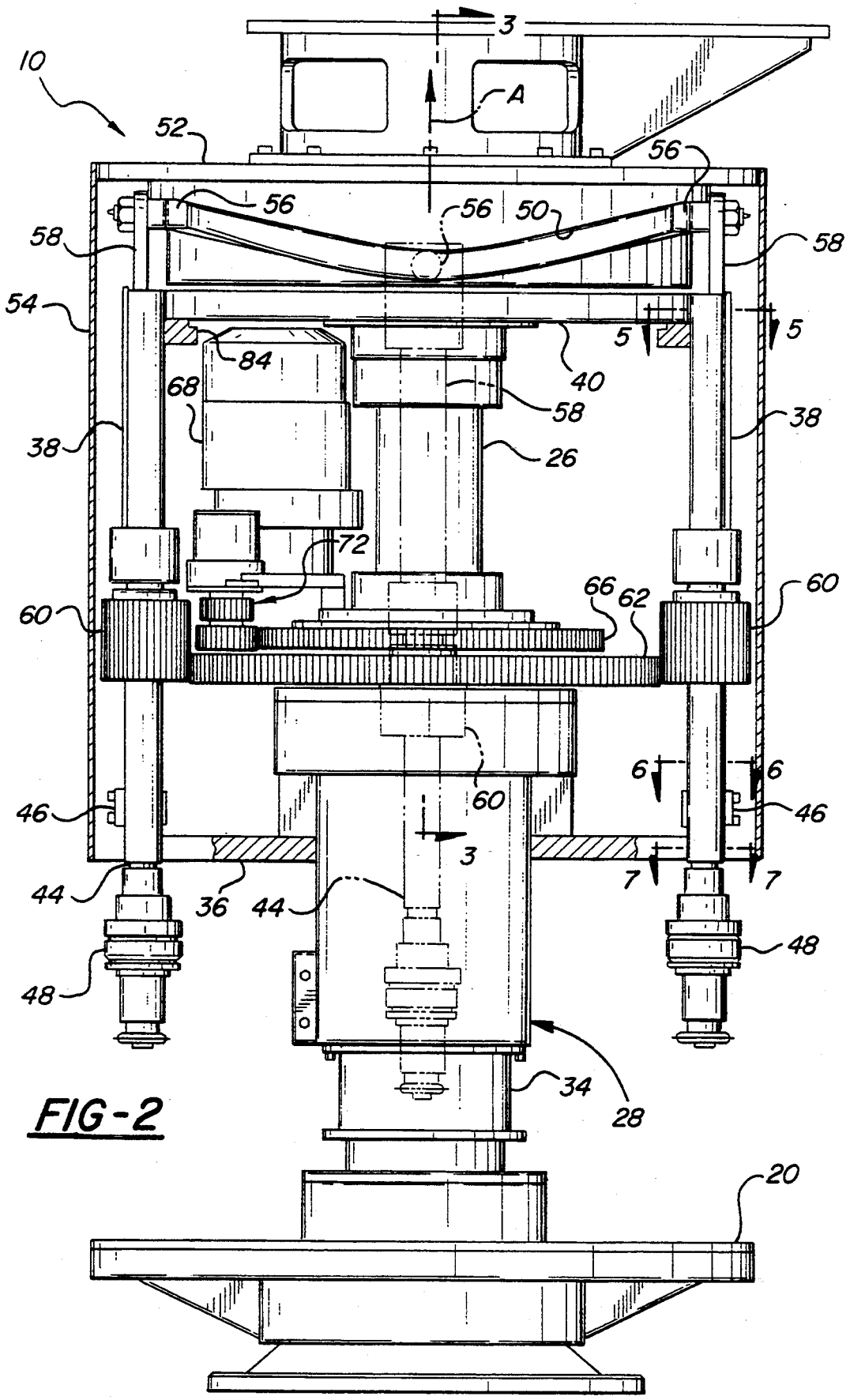
FIG. 2 is a cross-sectional view of the capping apparatus.
Figure 3:
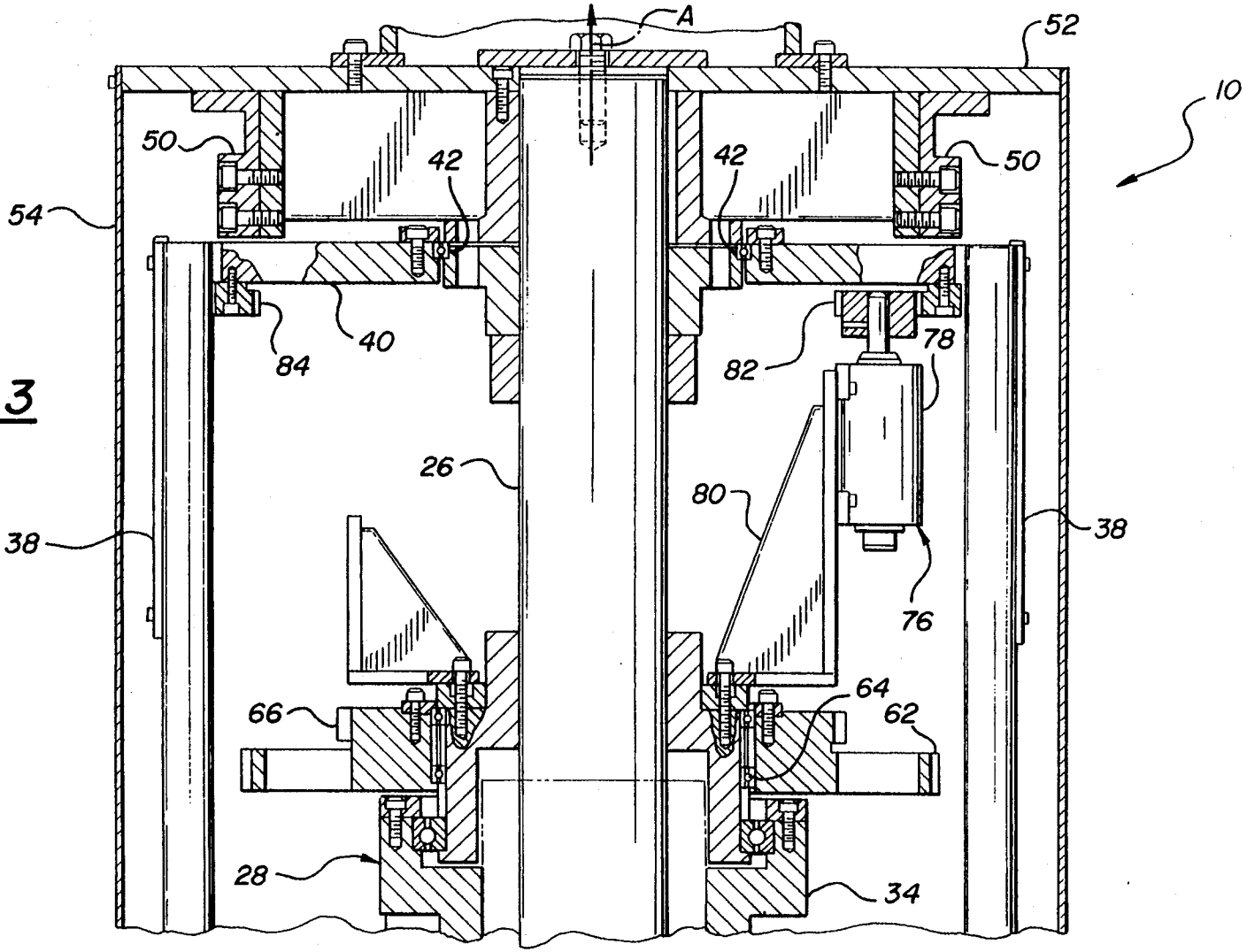
FIG. 3 is a fragmentary cross-sectional view taken along lines 3—3 of FIG. 2.

Referring now to FIGS. 2 and 3, the capping apparatus 10 is shown in cross-section including a stationary center shaft 26 having a vertical central axis A. A turret, generally indicated at 28, is rotatably carried about the center shaft 26. The table 20 is keyed to the turret 28 so they have the same relative rotational motion. A turret drive means, shown in FIG. 1, is provided for rotating the turret 28 about the central axis A at variable turret speeds to alter the bottle through put rate. The turret drive means, more particularly, comprises an electric motor 30 operatively connected to the turret 28. Preferably, the electric motor 30 also controls the infeed 18 and outfeed 22 star wheel speed through a drive belt 32 so that they are synchronized with the rotation of the table 20. The speed of the electric motor 30 is controlled through the control panel 24. Of course, those skilled in the art will be readily appreciate other drive arrangements which may or may not integrate the drive for the star wheels with the turret 28, as well as other connection alternatives between the electric motor 30 and the turret 28.

Figure 5:
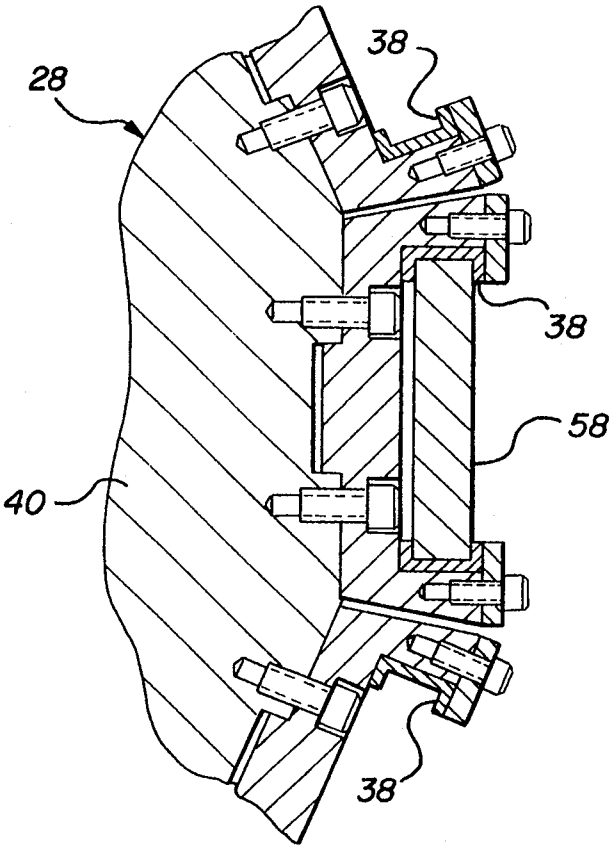
FIG. 5 is a cross-sectional view taken along lines 5—5 of FIG. 2.
Figure 7:
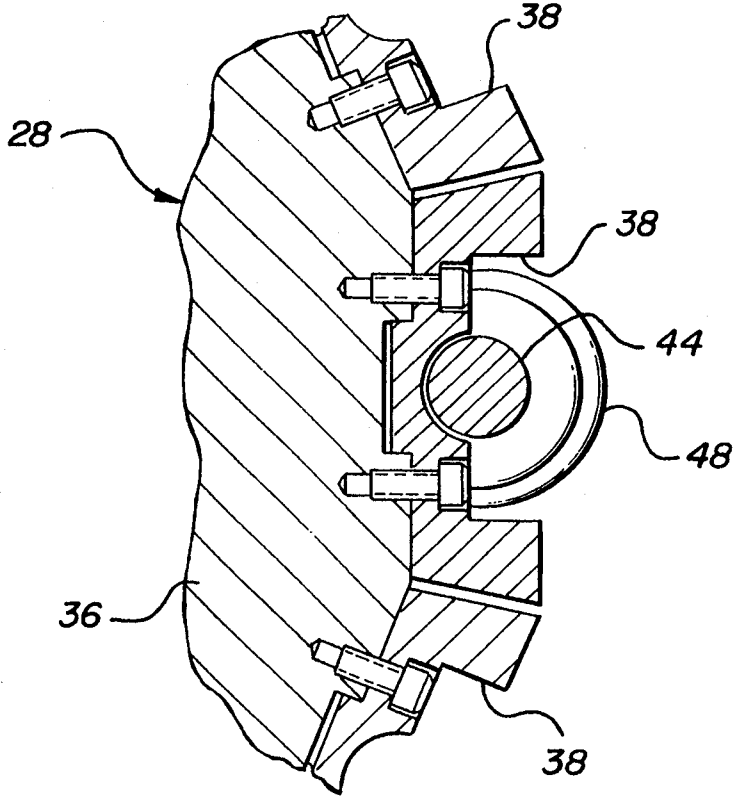
FIG. 7 is a cross-sectional view taken along lines 7—7 in FIG. 2.
Figure 6:
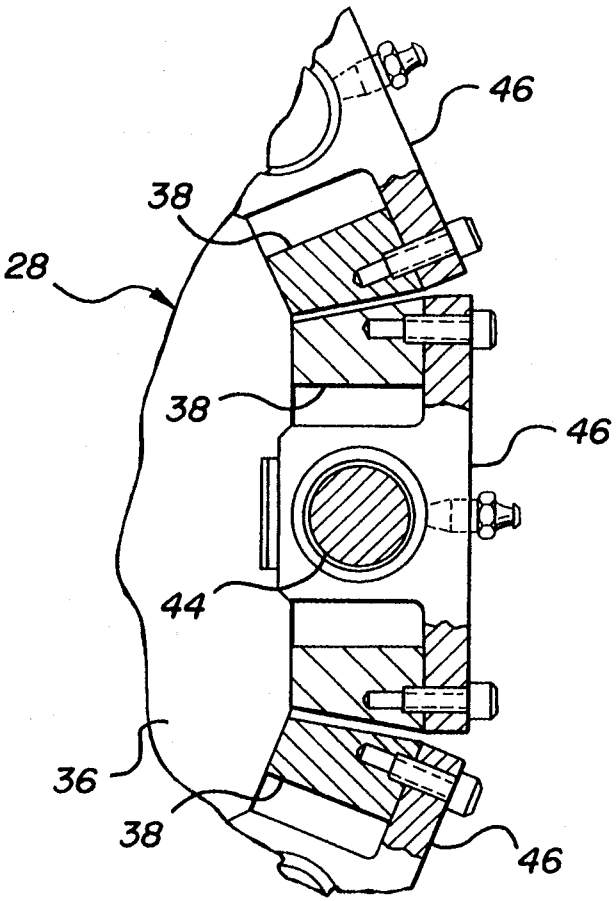
FIG. 6 is a cross-sectional view taken along lines 6—6 of FIG. 2.

Also forming part of the turret 28 is a sleeve 34 extending around the center shaft 26, and a lower mounting plate 36 extending radially from the sleeve 34. A plurality of slide tracks 38 are disposed circumferentially about the lower mounting plate 36, as best shown in FIGS. 5–7. These slide tracks 38 are formed in equal arcuate increments about the lower mounting plate 36. The slide tracks 38 extend upwardly, parallel to the central axis A, to an upper mounting plate 40. The upper mounting plate 40 is rotatably connected to the center shaft 26 by a bearing 42. Thus, as the electric motor 30 drives the turret 28, the table 20, sleeve 34, upper and lower mounting plates 40, 36 and slide tracks 38 all revolve about the central axis A.

A plurality of spindle shafts 44 are spaced circumferentially about the central axis A and are each rotatably supported on the turret 28. One spindle shaft 44 is associated with each of the slide tracks 38. As best shown in FIG. 6, one or more bearing holders 46 may be associated with each of the slide tracks 38 to support the respective spindle shaft 44 therein for rotation about an axis parallel to the central axis A. At the lower end of each spindle shaft 44 is attached a capping head 48. The capping head 48 may be of any type of well known in the art, such as an adjustable magnetic torquing head or the like. Such capping heads 48 include a clutching mechanism which effectively disconnects the rotating spindle shaft 44 from the cap 12 being applied when a predetermined torque is reached, i.e., the static torque.

An indexing means is operatively coupled to the spindle shafts 44 for individually reciprocating the capping heads 48 in directions parallel to the central axis A between retracted positions and extended capping positions as the turret 28 revolves about the central axis A. Referring again to FIGS. 2 and 3, the indexing means is shown including a barrel-type cam track 50 depending from a lid 52 of the center shaft 26. The cam track 50 encircles the central axis A and includes axially displaced portions typical of barrel cam arrangements. A cylindrical shroud 54 is attached to the outer edge of the lid 52 for enclosing a majority of the capping apparatus 10.

A follower 56 is operatively connected to each of the spindle shafts 44 and disposed within the cam track 50. Thus, sixteen followers 56 are positioned in equally spaced circumferential increments about the cam track 50 at varying axially displaced locations. An extension shaft 58 interconnects each of the spindle shafts 44 with their respective follower 56. The extension shafts 58, best shown in FIG. 5, are rectangular in cross section and are freely slideably disposed in the respective slide tracks 38. Each extension shaft 58 is connected to its corresponding spindle shaft 44 in such a manner that free rotation of the spindle shafts 44 are permitted while axial displacements of the followers 58 in the cam track 50 are transmitted to the spindle shafts 44 and capping heads 48. Accordingly, as the turret 28 revolves about the center shaft 26, the capping heads 48 reciprocated in carrousel-like fashion. When in the extended capping positions, the capping heads apply threaded caps 12 to the bottles 14, and when in the retracted positions, the capping heads 48 are recharged with fresh bottle caps 12. Any of the well known and readily adaptable cap feeding devices may be used with the subject capping apparatus 10.

A rotation means is provided for forcibly rotating each of the spindle shafts 44 in unison about respective axes parallel to the central axis A. The rotation means of the preferred embodiment includes a pinion gear 60 disposed on each of the spindle shafts 44 adjacent their connection with the associated extension shaft 58. A sun gear 62 is supported on the center shaft 26 and operatively engages the pinion gears 60. In this manner, the pinion gears 60 form satellites controlled by rotation of the turret 28 or the sun gear 62, or both. The axial length of the pinion gears 60 are long enough that the remain in contact with the sun gear 62 throughout the full range of reciprocation caused by the indexing means.

Figure 4:
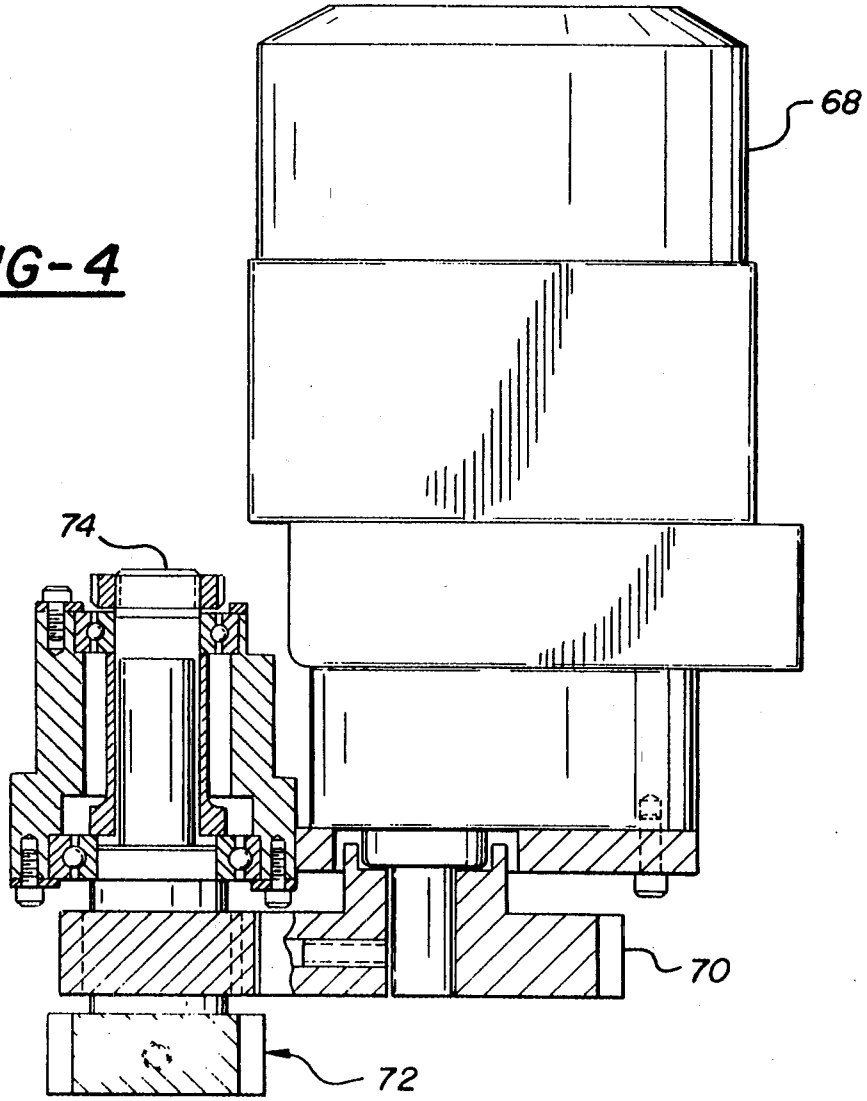
FIG. 4 shows the drive motor and the compound intermediate gear train in cross section.

A bearing 64 interconnects the sun gear 62 and the center shaft 26. A drive gear 66 is attached in compound to the sun gear 62, with the drive gear 66 having a smaller diameter than the sun gear 62. As best shown in FIGS. 2 and 4, a drive motor 68 is rigidly supported on the center shaft 26 and is operatively connected to the sun gear 62 by way of a drive pinion 70 extending from the drive motor 68. The drive pinion 70 operates through a compound intermediate gear train, generally indicated at 72, and is disposed in meshing engagement with the drive gear 66. The compound intermediate gear train 72 is supported for rotation upon an off set shaft 74.

If the drive motor 68 is not powered so that the drive pinion 70 and compound intermediate gear train 72 are held fixed, the drive gear 66 and sun gear 62 also remain stationary relative to the center shaft 26. The effect is that as the turret 28 rotates about the central axis A, the spindle shafts 44 are driven to rotate in unison by way of the intermeshing pinion gears 60 with the stationary sun gear 62. And, as will be readily apparent, the rotational speed of the spindle shafts 44 is directly related to, and is function of, the rotational turret speed. Thus, if bottle through put is increased, such that the turret 28 is rotated faster, the dynamic torque component resulting from the mass of the capping head 48 will result in the caps 12 being tightened onto the bottles 14 with a greater final torque tightness. However, according to the subject invention, the drive motor 68 is operative to control the speed of the sun gear 62 so that as the rotational speed of the turret 28 is increased, the rotational speed of the sun gear 62 is appropriately compensated with the end result being constant rotating speeds of the spindle shafts 44.

A control means, generally indicated at 76 in FIG. 3, is provided for directly sensing the instantaneous turret speed and reactively controlling the speed of the drive motor 68 so that the spindle shafts 44 are rotated at a constant rotational speed to thread caps 12 onto the bottles 14 with a constant final torque tightness which is independent of the turret 28 speed and the bottle through put rate. In other words, the control means 76 automatically computes and dictates the rotating speed of the sun gear 62 necessary to maintain a constant rotating speed of the spindle shafts 44 as a result of changes in the rotating speed of the turret 28.

The control means 76 includes a rotary encoder 78 supported on the center shaft 26 by a bracket 80. An encoder pinion 82 of the typical spur gear type is disposed on the rotary encoder 78. An internal ring gear 84 is fastened to the turret 28, below the upper mounting plate 40, for meshing with the encoder pinion 82. Thus, as the turret 28 rotates about the center shaft 26, the ring gear 84 drives the encoder pinion 82 and generates a feedback signal from the rotary encoder 78 which is directly proportional to the instantaneous rotating speed of the turret 28. These feedback signals are sent via an electrical bus (not shown) to a central processing unit (CPU) housed within the control panel 24. The CPU receives these feedback signals from the rotary encoder 78, compares the feedback signals to stored reference data, computes an optimum speed for the drive motor 68, and finally controls the drive motor 68 to operate at that computed speed in response to the comparisons made so that the spindle shafts 44 continuously rotate at the same rotational speed.

In this manner, during any bottle capping operation, an operator simply programs bottle through put speed changes into the control panel 24, thereby changing the instantaneous rotating speed of the turret 28, and the CPU in the control panel 24 computes a new operating speed for the drive motor 68 which in turn causes the spindle shafts 44 to continue rotating at their previous speed. This occurs instantaneously, even though the rotating speed of the turret 28 has been altered. The effect is that caps 12 are applied to the bottles 14 with a constant final torque tightness so that constant sealing of the bottles 14 is achieved wholly regardless of the bottle through put rate. In addition, the spindle speed can be manually (i.e., through the control panel 24) adjusted to raise and lower the constant spindle speed in the field. Because the spindle speed directly contributes to the dynamic torque component of cap tightness, cap tightness can be spontaneously adjusted by varying the spindle speed without affecting the bottle through put rate.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A capping apparatus (10) for threading caps (12) onto bottles (14) at a constant threading speed independent of the bottle through put rate, said apparatus comprising: a center shaft (26) having a vertical central axis (A); a turret (28) rotatably carried about said center shaft (26); turret drive means (30) for rotating said turret (28) about said central axis (A) at variable turret speeds to alter the bottle through put rate; a plurality of spindle shafts (44) spaced circumferentially about said central axis (A) and each rotatably supported on said turret (28); a capping head (48) disposed on each of said spindle shafts (44); rotation means for forcibly rotating each of said spindle shafts (44) in unison about respective axes parallel to said central axis (A); and characterized by control means (76) for directly sensing the instantaneous turret speed and reactively controlling said rotation means to rotate said spindle shafts (44) at a constant rotational speed to thread caps (12) onto the bottles (14) with a constant final torque tightness independent of the turret speed and the bottle through put rate.

2. An apparatus as set forth in claim 1 wherein said control means includes a rotary encoder (78) supported on said center shaft (26).

3. An apparatus as set forth in claim 2 wherein said control means (76) includes a ring gear (84) attached to said turret (28).

4. An apparatus as set forth in claim 3 wherein said rotary encoder (78) includes an encoder pinion (82) in meshing engagement with said ring gear (84).

5. An apparatus as set forth in claim 2 wherein said rotation means includes a pinion gear (60) disposed on each of said spindle shafts (44).

6. An apparatus as set forth in claim 5 wherein said rotation means includes a sun gear (62) supported on said center shaft (26) and operatively engaging said pinion gears (60).

7. An apparatus as set forth in claim 6 further including a bearing (64) interconnecting said sun gear (62) and said center shaft (26).

8. An apparatus as set forth in claim 7 further including a drive motor (68) supported on said center shaft (26) and operatively connected to said sun gear (62).

9. An apparatus as set forth in claim 8 further including a drive gear (66) attached in compound to said sun gear (62).

10. An apparatus as set forth in claim 9 further including a drive pinion (70) extending from said drive motor (68).

11. An apparatus as set forth in claim 10 further including a compound intermediate gear train (72) disposed in meshing engagement between said drive pinion (70) and said drive gear (66).

12. An apparatus set forth in claim 8 further including a central processing unit for receiving feedback signals from said rotary encoder (78), comparing said feedback signals to store reference data, and controlling said drive motor (68) in response to the comparison.

13. An apparatus as set forth in claim 12 further including indexing means operatively coupled to said spindle shafts (44) for individually reciprocating said capping heads (48) in directions parallel to said central axis (A) between retracted positions and extended capping positions as said turret (28) revolves about said central axis (A).

14. An apparatus as set forth in claim 13 wherein said indexing means includes a cam track (50).

15. An apparatus as set forth in claim 14 wherein said indexing means includes a follower (56) operatively connected to each of said spindle shafts (44) and disposed in said cam track (50).

16. An apparatus as set forth in claim 15 wherein said indexing means includes an extension shaft (58) interconnecting each of said spindle shafts (44) with the respective said follower (56).

17. An apparatus as set forth in claim 16 wherein said turret (28) includes a slide track (38) slideably supporting each of said extension shafts (58).

18. An apparatus as set forth in claim 17 wherein said turret (28) includes an upper mounting plate (40) and a lower mounting plate (36), with said slide tracks (38) extending therebetween.

* * * * *